US011174690B2

(12) United States Patent
Robey et al.

(10) Patent No.: US 11,174,690 B2
(45) Date of Patent: Nov. 16, 2021

(54) PRESSURE CYCLE DEVICE

(71) Applicant: Halliburton Energy Services, Inc., Houston, TX (US)

(72) Inventors: Richard Ellis Robey, Mansfield, TX (US); Christopher C. Hoelscher, Arlington, TX (US); Jason Karl Cook, Crowley, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/590,578

(22) Filed: Oct. 2, 2019

(65) Prior Publication Data

US 2021/0102433 A1 Apr. 8, 2021

(51) Int. Cl.

| | |
|---|---|
| ***E21B 23/00*** | (2006.01) |
| ***E21B 34/10*** | (2006.01) |
| ***E21B 23/04*** | (2006.01) |
| *E21B 43/116* | (2006.01) |

(52) U.S. Cl.

CPC ..... *E21B 23/006* (2013.01); *E21B 23/04* (2013.01); *E21B 34/10* (2013.01); *E21B 43/116* (2013.01)

(58) Field of Classification Search

CPC ..... E21B 23/006; E21B 23/0412; E21B 43/11852

See application file for complete search history.

(56) References Cited

U.S. PATENT DOCUMENTS

| | | | | |
|---|---|---|---|---|
| 3,216,332 | A * | 11/1965 | De Chambeau | F16F 9/18 92/5 R |
| 4,726,610 | A | 2/1988 | George et al. | |
| 4,732,211 | A | 3/1988 | Haugen et al. | |
| 5,180,015 | A * | 1/1993 | Ringgenberg | E21B 34/063 166/386 |
| 5,887,654 | A | 3/1999 | Edwards et al. | |
| 8,006,779 | B2 | 8/2011 | Moore et al. | |
| 8,061,431 | B2 | 11/2011 | Moore et al. | |
| 2004/0118562 | A1 | 6/2004 | George | |
| 2014/0246246 | A1 | 9/2014 | Radford | |

* cited by examiner

*Primary Examiner* — Cathleen R Hutchins

(74) *Attorney, Agent, or Firm* — John Wustenberg; Parker Justiss, P.C.

(57) ABSTRACT

Provided is a pressure cycle actuation assembly. The pressure cycle actuation assembly, in one aspect, includes a housing, a reciprocating piston located within the housing and defining first and second fluid chambers, and a check valve positioned between the first and second fluid chambers, the check valve permitting fluid flow from the first fluid chamber to the second fluid chamber but preventing fluid flow from the second fluid chamber to the first fluid chamber. The A pressure cycle actuation assembly, according to this aspect, further includes a flow restrictor positioned between the first and second fluid chambers, the flow restrictor restricting fluid flow between the first fluid chamber and the second fluid chamber, and a rotating collet coupled to the reciprocating piston, the rotating collet translating reciprocal axial motion of the reciprocating piston into one-direction rotation and axial lengthening or shortening of the rotating collet relative to the reciprocating piston.

20 Claims, 18 Drawing Sheets

PRESSURE CYCLE DEVICE

BACKGROUND

In the process of completing an oil or gas well, it is common to lower tool strings into the well on long lengths of tubing, typically from a coiled roll. The tubing serves not only to support the weight of the string of tools in the well, but also to transmit pressure from the surface of the well for activating the downhole tools to perform various functions, such as sealing the wellbore or perforating the well casing for access to product-bearing deposits, as well as testing the integrity of drill string or well completion.

Also, because of the cost advantages of performing as many functions as possible with one trip down the wellbore, several attempts have been made to conduct the integrity testing while a tubing-conveyed perforating system is downhole. Typically, either pressure activated firing heads or electronic activated firing heads are used as part of the tubing-conveyed perforating system.

BRIEF DESCRIPTION

Reference is now made to the following descriptions taken in conjunction with the accompanying drawings, in which.

DETAILED DESCRIPTION

Figure 1:
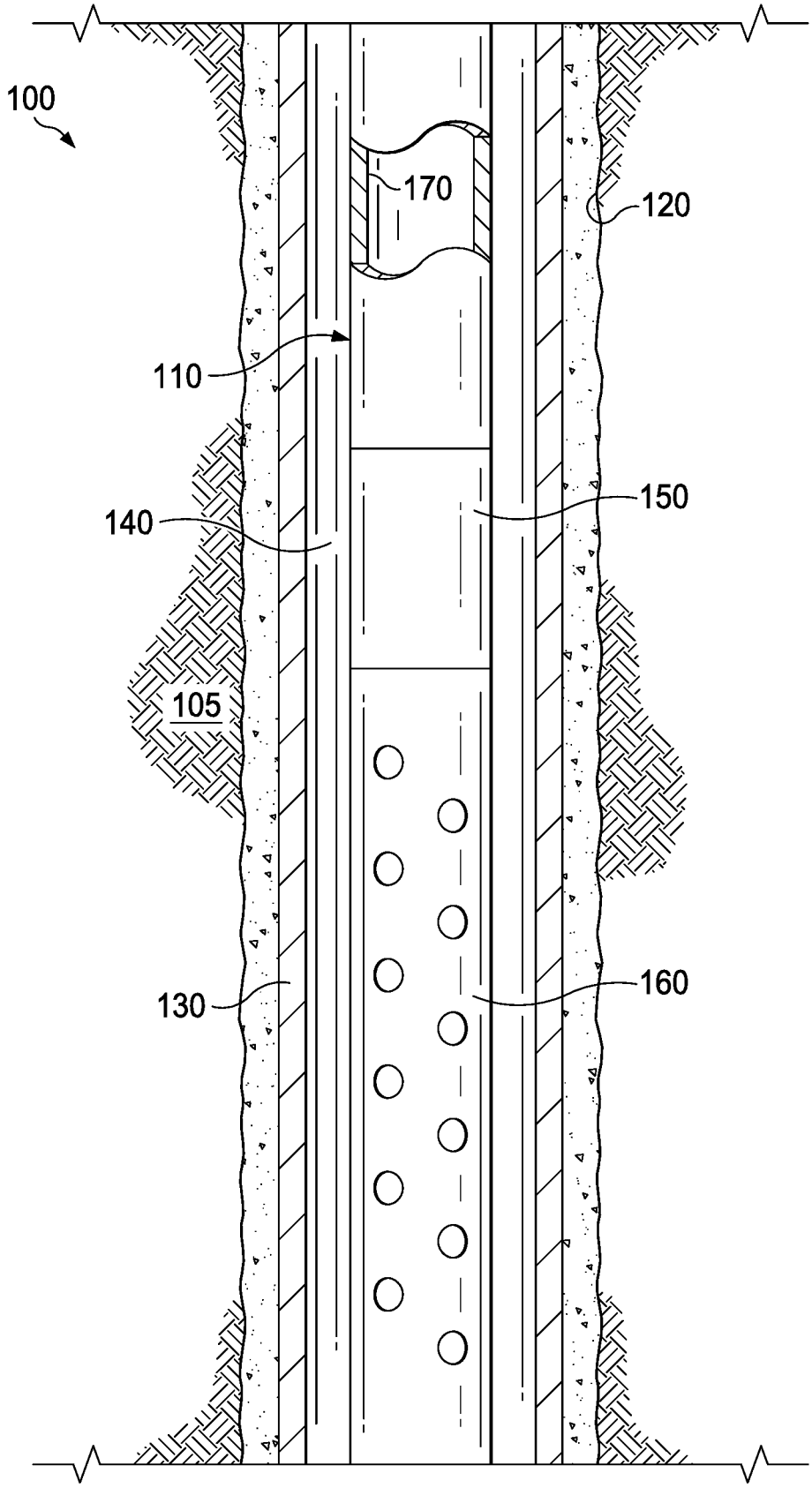
FIG. 1 is an elevation view of a well system including a pressure cycle actuation assembly manufactured and desired according to the disclosure.

In the drawings and descriptions that follow, like parts are typically marked throughout the specification and drawings with the same reference numerals, respectively. The drawn figures are not necessarily to scale. Certain features of the disclosure may be shown exaggerated in scale or in somewhat schematic form and some details of certain elements may not be shown in the interest of clarity and conciseness. The present disclosure may be implemented in embodiments of different forms.

Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed herein may be employed separately or in any suitable combination to produce desired results.

FIG. 1 is an elevation view of a well system 100 including a pressure cycle actuation assembly manufactured and desired according to the disclosure. In the well system 100, a tubular string 110 has been conveyed into a wellbore 120 located within a subterranean formation 105 and lined with casing 130, thereby forming an annulus 140. The tubular string 110 includes a pressure cycle actuation assembly 150 for activating another downhole tool 160 coupled thereto. In the embodiment of FIG. 1, the downhole tool 160 is a perforating gun. Accordingly, the pressure cycle actuation assembly 150 is configured to initiate the perforating gun (e.g., detonate explosive shaped charges of the perforating gun), in order to form perforations through the casing 130.

In this example, multiple pressure cycles are applied to an internal flow passage 170 extending longitudinally through the tubular string 110 and in fluid communication with the pressure cycle actuation assembly 150. When a predetermined number of the pressure cycles have been applied, the pressure cycle actuation assembly 150 initiates the downhole tool 160 (e.g., in the embodiment of FIG. 1 detonating of the explosives in the perforating gun).

The well system 100 as depicted in FIG. 1 is just one example of a wide variety of specific applications for the principles described in this disclosure. The details of the well system 100 of FIG. 1 are not strictly necessary in order to take advantage of the principles of this disclosure. For example, the wellbore 120 could be horizontal or inclined, instead of vertical as depicted in FIG. 1. Similarly, the pressure cycle actuation assembly 150 could be used to initiate combustion of a propellant to set a packer, or could be used to initiate detonation of a casing or tubing cutter, or any other downhole tool that may be initiated. Thus, it should be clearly understood that the examples described herein are not intended to limit in any way the many varied applications for the principles of this disclosure.

Figure 2:
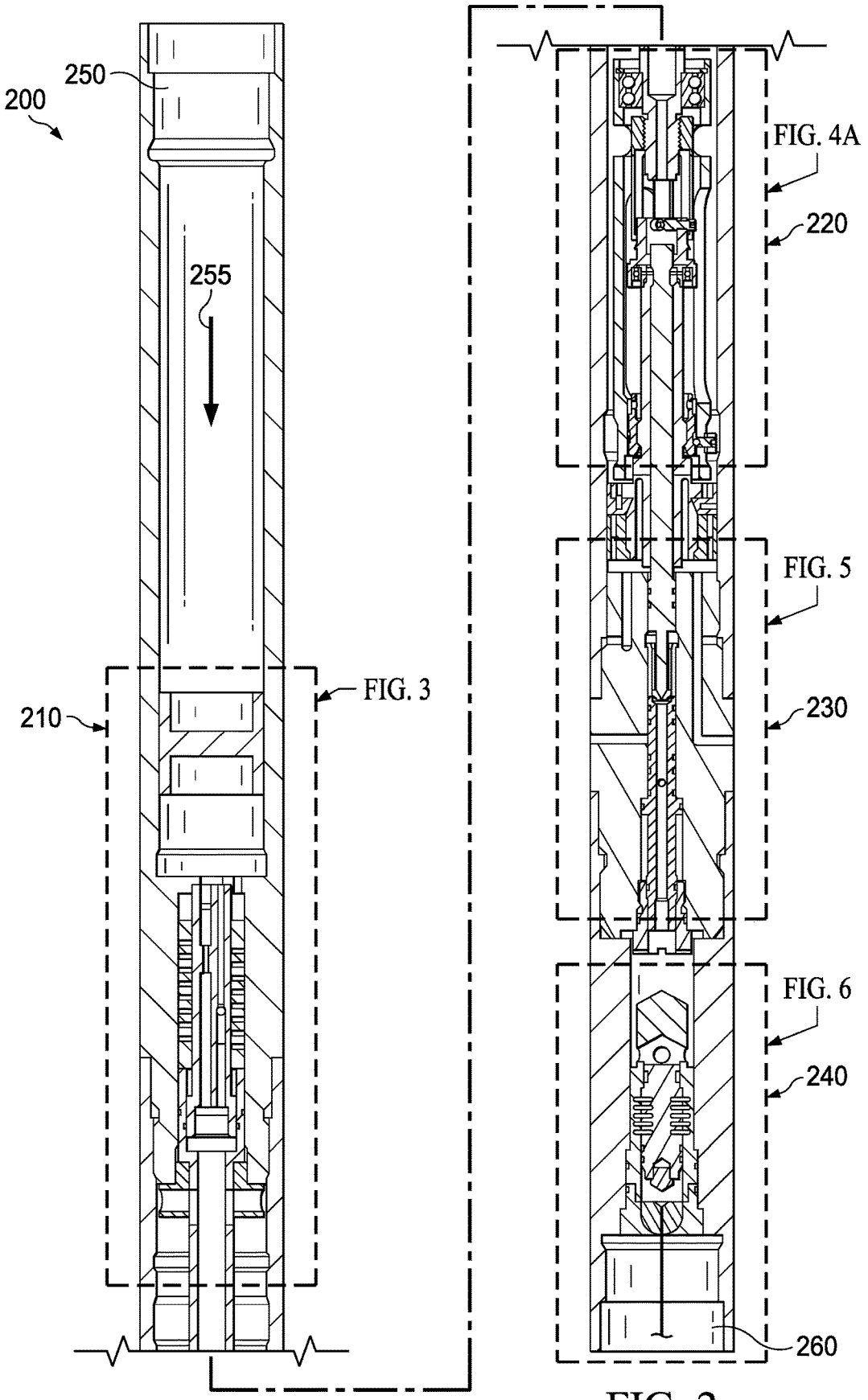
FIG. 2 is an enlarged scale cross-sectional view of a pressure cycle actuation assembly manufactured and designed according to the disclosure.

FIG. 2 is an enlarged scale cross-sectional view of a pressure cycle actuation assembly 200 manufactured and designed according to the disclosure, which is representatively illustrated apart from the remainder of the well system, such as the well system 100 of FIG. 1. Of course, the pressure cycle actuation assembly 200 can be used in well systems other than the well system 100 in keeping with the principles of this disclosure. The pressure cycle actuation assembly 200, in the illustrative embodiment of FIG. 2, includes a cycling assembly 210, a rotation assembly 220, an initiation assembly 230, and in one embodiment a firing assembly 240. While not shown, the pressure cycle actuation assembly 200 could be coupled to an initiatable downhole tool, such as a perforating gun, a tubing cutter, a packer, a plug, a vent, a tubing release, a valve, a setting tool, or another tool capable of a downhole action.

The pressure cycle actuation assembly 200, in the illustrated embodiment, includes an upper connector 250, which provides for sealed and threaded interconnection to a tubular string, such as the tubular string 110 illustrated in FIG. 1. In this embodiment, a flow passage 255 is in fluid communication with the cycling assembly 210. The pressure cycle actuation assembly 200, in the illustrated embodiment, additionally includes a lower connector 260, which provides for a sealed and threaded connection to the initiatable downhole tool, such as the downhole tool 160 illustrated in FIG. 1 or any of the downhole tools discussed herein.

Figure 3:
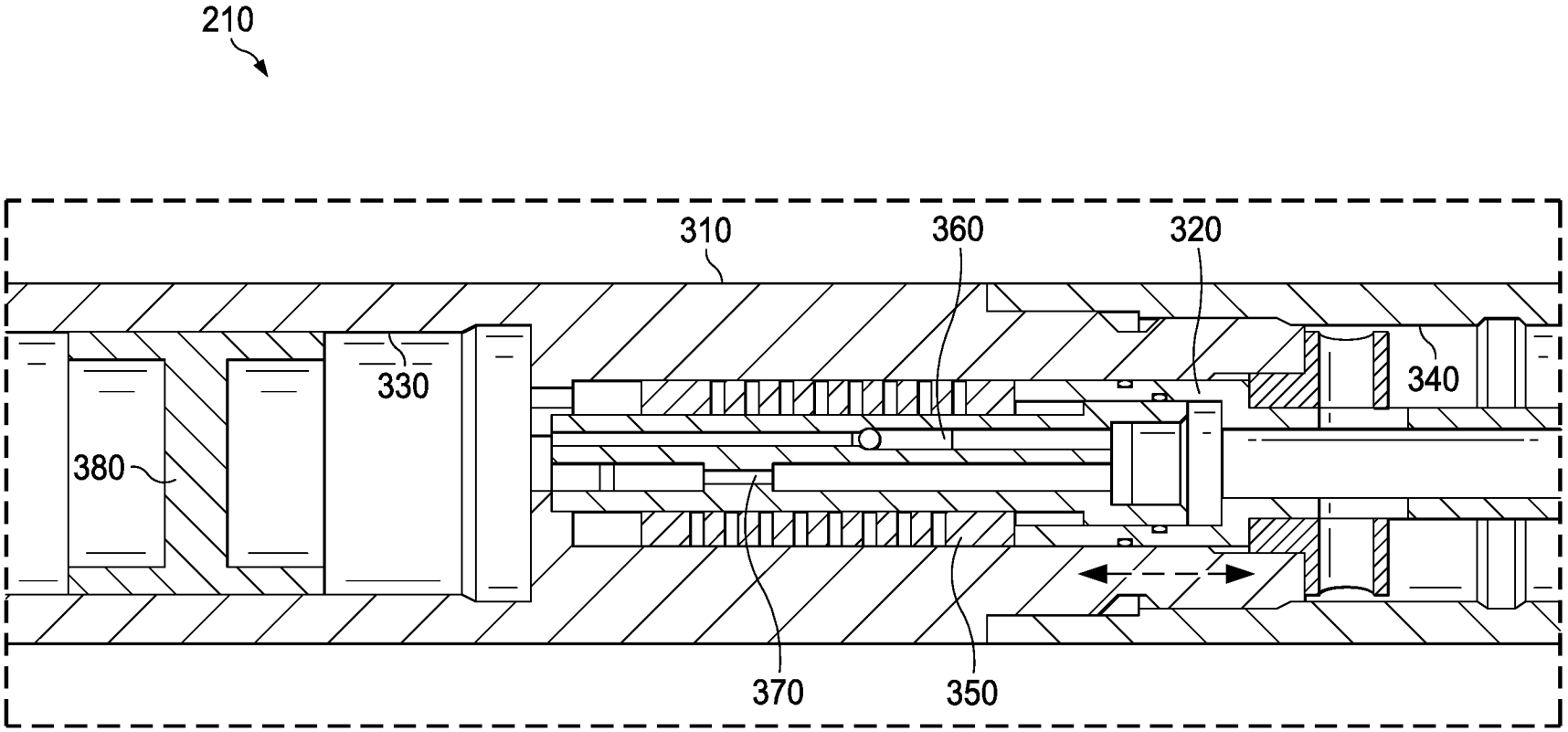
FIG. 3 is a zoomed in view of the cycle actuation assembly illustrated in FIG. 2.

FIG. 3 is a zoomed in view of the cycle actuation assembly 210 illustrated in FIG. 2. The cycle actuation assembly 210, in the illustrated embodiment, includes a housing 310. The housing 310 need not comprise a single housing, and in certain embodiments may comprise multiple separate housings that come together to form the housing 310. The housing 310, in this embodiment, has a reciprocating piston 320 located therein. The reciprocating piston 320, in the illustrated embodiment, forms a first fluid chamber 330 and a second fluid chamber 340 within the housing 310. Both of the first and second fluid chambers 330, 340 are preferably entirely filled with a compressible fluid. The fluid is preferably a compressible liquid, such as a silicone fluid, etc.

The cycle actuation assembly 210 additionally includes a biasing device 350 located within the housing 310. The biasing device 350 may be a compression spring, machined spring, or another type of spring member and remain within the purview of the disclosure. The biasing device 350, in the illustrated embodiment, biases the reciprocating piston 320 toward the second fluid chamber 340. Thus, in a balanced pressure state (e.g., a state wherein the pressure in the first fluid chamber 330 is substantially the same as the second fluid chamber 340), the reciprocating piston 320 will be in its downwardly disposed position, as depicted in FIG. 3. Notwithstanding, the biasing device 350 has a suitable "spring constant" that when overcome by an increase in pressure in the second fluid chamber 340 relative to the first fluid chamber 330, allows the reciprocating piston 320 to move toward the first fluid chamber 330, which is discussed in greater detail below.

The cycle actuation assembly 210 additionally includes a check valve 360 positioned between the first and second fluid chambers 330, 340. The check valve 360, in the illustrated embodiment, permits fluid flow from the first fluid chamber 330 to the second fluid chamber 340, but prevents fluid flow from the second fluid chamber 340 to the first fluid chamber 330. The cycle actuation assembly 210 illustrated in FIG. 3 additionally includes a flow restrictor 370 positioned between the first and second fluid chambers 330, 340. The flow restrictor 370, in this embodiment, restricts fluid flow between the first fluid chamber 330 and the second fluid chamber 340. For instance, the flow restrictor 370 is designed to slowly release fluid from the second fluid chamber 340 to the first fluid chamber 330 when the pressure is lowered in the first fluid chamber 330.

The cycle actuation assembly 210 additionally includes a floating piston 380 located within the housing 310. The floating piston 380, in the illustrated embodiment, has its upper side exposed to the flow passage 255 of the tubular string. When the pressure cycle actuation assembly 200 and the remainder of the tubular string are installed in the well, hydrostatic pressure in the flow passage 255 and in the annulus surrounding the pressure cycle actuation assembly 200 will slowly increase. The floating piston 380 will transmit this increased hydrostatic pressure to the first fluid chamber 330, and to the second fluid chamber 340 via the check valve 360 and flow restrictor 370, so pressure across the reciprocating piston 320 will remain balanced.

Figure 4A:
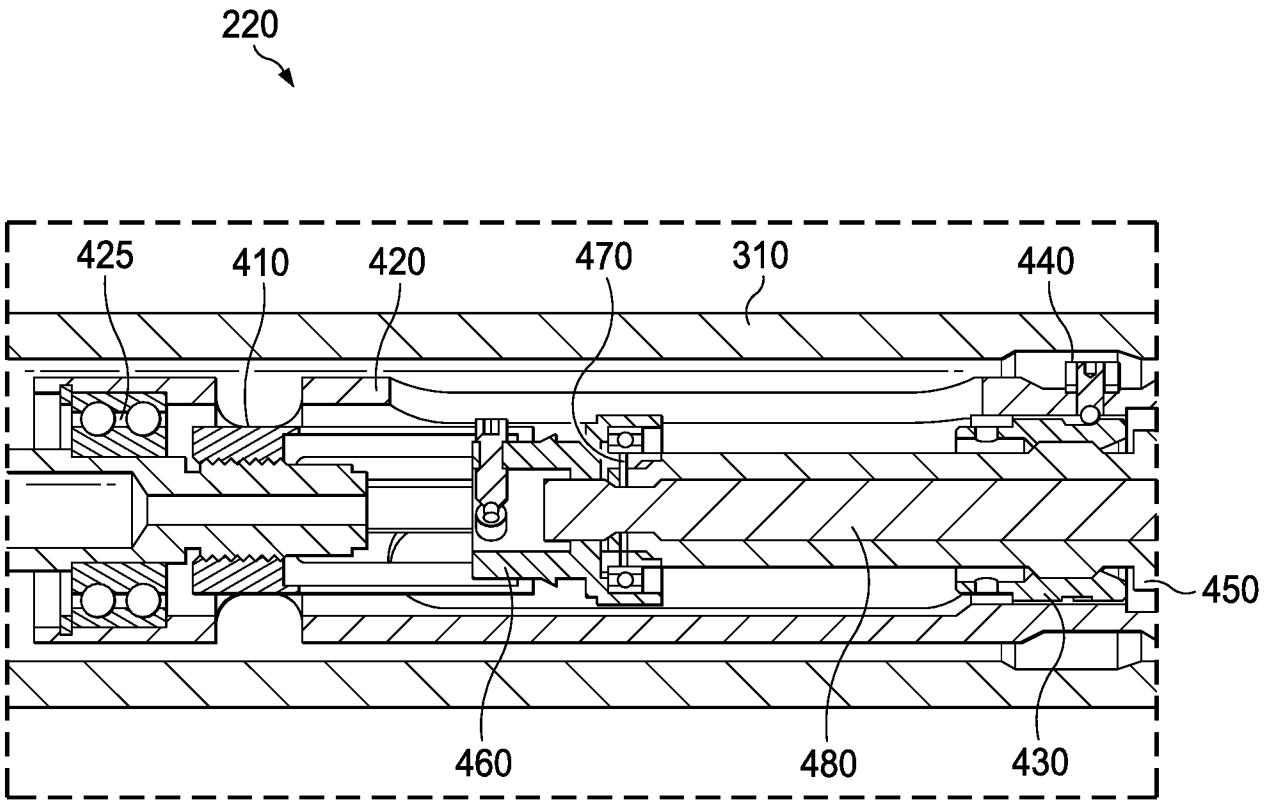
FIGS. 4A-4F are zoomed in views of the rotation assembly, and certain of the features thereof, illustrated in FIG. 2.
Figure 4B:
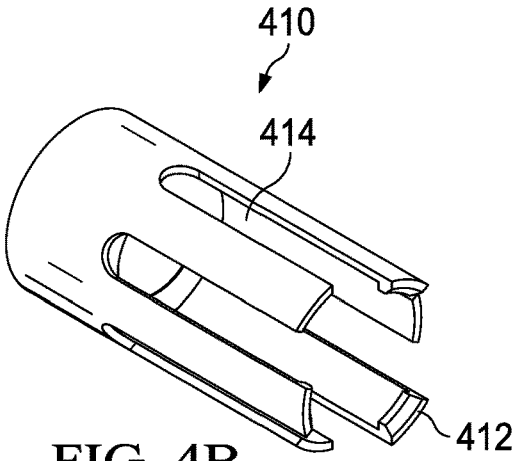

FIG. 4A is a zoomed in view of the rotation assembly 220 illustrated in FIG. 2. The rotation assembly 220 illustrated in the embodiment of FIG. 4A includes a rotating collet 410 coupled to the reciprocating piston 320. In the illustrated embodiment, and in accordance with the principles of the disclosure, the rotating collet 410 translates reciprocal axial motion of the reciprocating piston 320 into one-direction rotation and axial lengthening or shortening of the rotating collet 410 relative to the reciprocating piston 320. In one example embodiment, the rotating collect 410 is threadingly coupled to the reciprocating piston 320. FIG. 4B is a separate isometric view of the rotating collet 410. In the illustrated embodiment of FIG. 4B, the rotating collet 410 includes a profiled end 412 and axial movement slots 414.

Figure 4C:
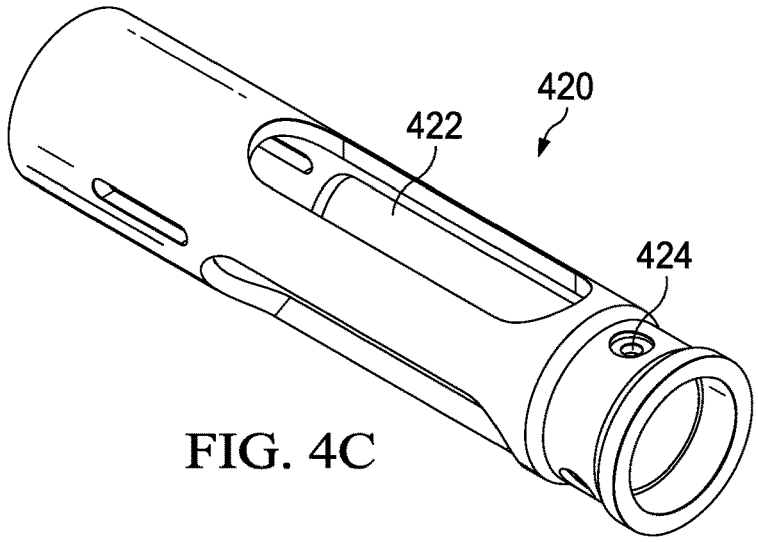

Returning to FIG. 4A, the rotation assembly 220 additionally includes a rotating sleeve 420 fixedly coupled to the rotating collet 410. The rotating sleeve 420, like the rotating collet 410, is configured to rotate about the reciprocating piston 320. In fact, in the illustrated embodiment of FIG. 4A, the rotating sleeve 420 rotates about the reciprocating piston 320 using one or more bearings 425. FIG. 4C is a separate isometric view of the rotating sleeve 420. In the illustrated embodiment of FIG. 4C, the rotating sleeve 420 includes one or more slots 422, and one or more holes 424 extending there through. As will be discussed below, the one or more holes 424 are configured to accept one or more followers.

Returning to FIG. 4A, the rotation assembly 220 additionally includes a stationary profiled ring 430. The stationary profiled ring 430, in the illustrated embodiment, is rotationally fixed relative to the reciprocating piston 320. The stationary profiled ring 430, as shown in FIG. 4A, is coupled to the rotating collet 410 through the rotating sleeve 420. Accordingly, the stationary profiled ring 430 and the rotating collet 410 collectively translate the reciprocal axial motion of the reciprocating piston 320 into one-direction rotation and axial lengthening or shortening of the rotating collet 410 relative to the reciprocating piston 320.

Figure 4D:
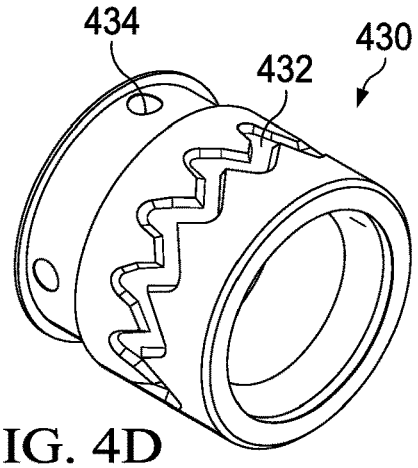

FIG. 4D is a separate isometric view of the stationary profiled ring 430. In the illustrated embodiment of FIG. 4D, the stationary profiled ring 430 includes one or more j-slots 432. As those skilled in the art may appreciate, the j-slots 432 help convert linear movement of the reciprocating piston 320 into one-direction rotational movement of the rotating collet 410, and thus axial lengthening or shortening of the rotating collet 410 relative to the reciprocating piston 320. Depending on the shape of the j-slots 432, the stationary profiled ring 430 may translate any one or both of downhole or uphole axial movement of the reciprocating piston 320 into one-direction rotational movement of the rotating collet 410, and thus axial lengthening or shortening of the rotating collet 410 relative to the reciprocating piston 320.

In the embodiment illustrated in FIG. 4A, the one-direction rotational movement of the rotating collet 410 causes axial lengthening the rotating collet 410 relative to the reciprocating piston 320, for example using a follower 440 coupled to the rotating sleeve 420. Notwithstanding, a configuration may exist wherein the one-direction rotational movement of the rotating collet 410 axial shortens the rotating collet 410 relative to the reciprocating piston 320. The stationary profiled ring 430 of FIG. 4D additionally includes one or more openings 434 extending there through, as might be used to accept a lock pin for rotatably fixing the stationary profiled ring 430 relative to the reciprocating piston 320.

Figure 4E:
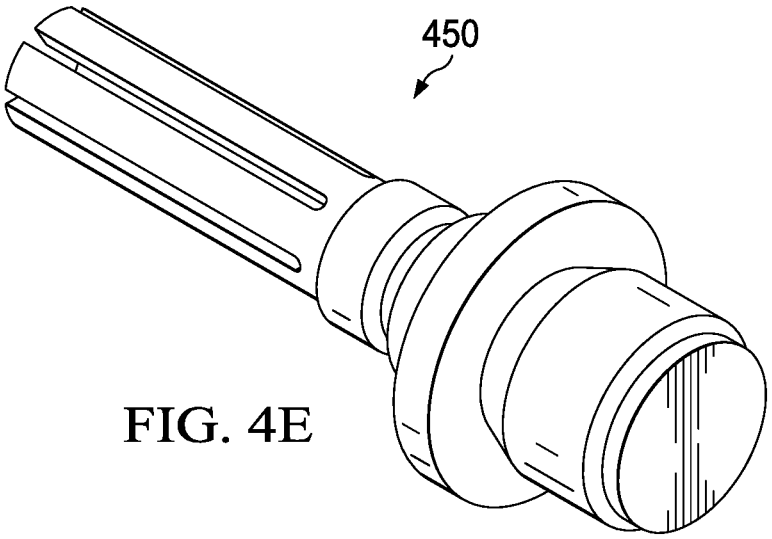

Returning to FIG. 4A, the rotation assembly 220 additionally includes a stationary collet 450. The stationary collet 450, in the illustrated embodiment, is positioned within the stationary profiled ring 430, and furthermore is rotatably fixed with the stationary profiled ring 430 using the one or more openings 434 and a lock pin or another locking feature. FIG. 4E is a separate isometric view of the stationary collet 450.

Figure 4F:
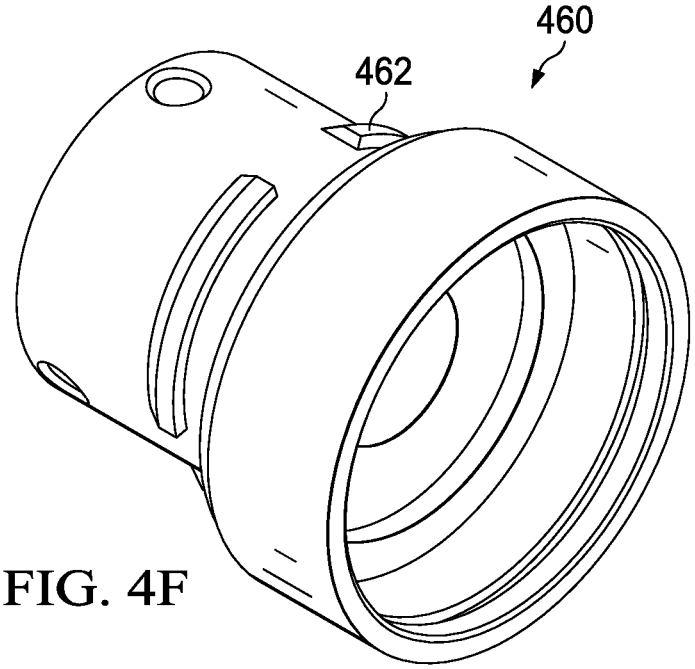

Returning to FIG. 4A, the rotation assembly 220 additionally includes a rotating overshot 460 located within the housing 310. The rotating overshot 460, in the illustrated embodiment, is rotationally fixed to the stationary collet 450. Turning briefly to FIG. 4F, illustrated is a separate isometric view of the rotating overshot 460. FIG. 4F is a separate isometric view of the rotating overshot 460 includes a profile 462. The profile 462, in the illustrated embodiment, is engageable with the profiled end 412 of the rotating collet 410, for example as the rotating collet 410 lengthens or shortens relative to the reciprocating piston 320.

Returning to FIG. 4A, the rotation assembly 220 additionally includes a shear feature 470 coupling the rotating overshot 460 to an actuator piston 480, for example through a stationary overshot 465. The shear feature 470, in the illustrated embodiment, is a shear pin. According to this embodiment, the shear feature 470 is shearable when the profile 462 of the rotating overshot 460 engages with the profiled end 412 of the rotating collet 410, and the reciprocating piston 320 is withdrawn uphole (e.g., for example employing a pressure cycle).

Figure 5:
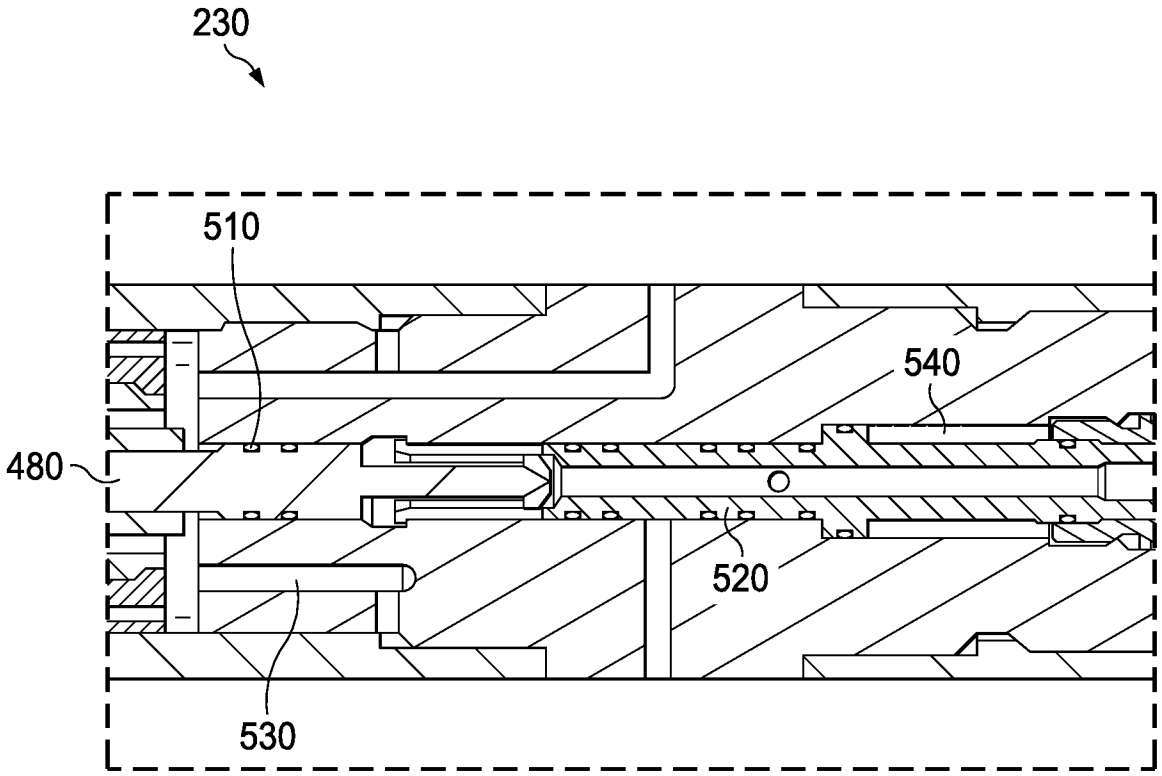
FIG. 5 is a zoomed in view of the initiation assembly illustrated in FIG. 2.

FIG. 5 is a zoomed in view of the initiation assembly 230 illustrated in FIG. 2. The initiation assembly 230, in the embodiment illustrated in FIG. 5, includes the actuator piston 480. The actuator piston 480, in this embodiment, includes actuator piston seals 510. The initiation assembly 230 additionally includes a balanced valve 520. Accordingly, the actuator piston 480 is extendable, as it is exposed to pressure external to the pressure cycle actuation assembly 200 via ports 530. In the well system 100 of FIG. 1, the exterior of the pressure cycle actuation assembly 200 corresponds to an annulus 140 formed radially between the tubular string 110 and the casing 130. However, in other examples, the actuator piston 480 could be exposed to other pressure sources, such as the flow passage 255 of the tubular string, etc.

A pressure chamber 540 below the actuator piston 480 is preferably held at atmospheric pressure (or another relatively low pressure). Accordingly, the actuator piston 480 may be biased downwardly by the much greater pressure above the actuator piston 480 than below the actuator piston 480. However, as discussed above, the shear feature 470 prevents the actuator piston 480 from being driven downward until a predetermined number of pressure cycles have been applied, and the shear feature 470 has been sheared, as described more fully below.

Figure 6:
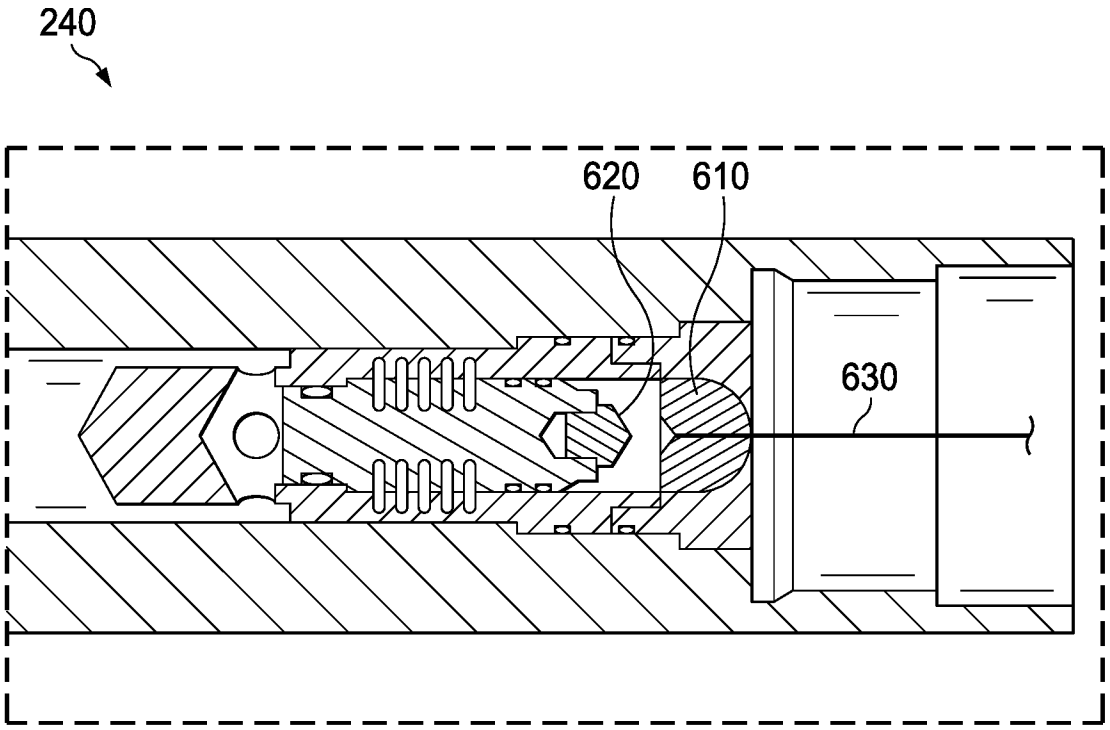
FIG. 6 is a zoomed in view of the firing assembly illustrated in FIG. 2.

FIG. 6 is a zoomed in view of the firing assembly 240 illustrated in FIG. 2. In the illustrated embodiment, an explosive initiator 610 is positioned below a firing pin 620. When the firing pin 620 impacts the explosive initiator 610 with sufficient force, such as might be the case when the actuator piston 480 is forcefully biased toward the firing assembly 240, explosives in the explosive initiator 610 will ignite and initiate detonation of an explosive train including, for example, an explosive detonating cord 630 which in one embodiment extends through to downhole tool (not shown) and is used to cause detonation of the shaped charges therein.

Of course, many other types of devices, explosives, combustibles, propellants, fuses, etc. can be initiated using the pressure cycle actuation assembly 200. In addition, it is not necessary for an explosive train to be continuous, since pressure barriers, additional firing pins and initiators, etc. can be interposed, for example, between perforating guns or at spacers used to space apart perforating guns, etc.

Returning to FIG. 2, with references to FIGS. 3-6, when the pressure cycle actuation assembly 200 has been appropriately positioned in the casing (e.g., to form perforations through the casing at a particular depth, or for another reason), a number of pressure cycles increases and decreases will be applied to the flow passage 255 (e.g., using a pump or other pressure source at the surface) to cause the reciprocating piston 320 to reciprocate up and down. As discussed above, the rotating collet 410 then translates the reciprocal axial motion of the reciprocating piston 320 into one-direction rotation and axial lengthening or shortening of the rotating collet 410 relative to the reciprocating piston 320. In the instant embodiment, the axial lengthening of the rotating collet 410 causes the profiled end 412 of the rotating collet 410 to engage the profile 462 of the rotating overshot 460. Once the profile end 412 engages the profile 462, one additional pressure cycle withdraws the rotating overshot 460 (e.g., uphole in the illustrated embodiment), thereby shearing the shear feature 470 and allowing the pressure differential across the actuator piston 480 to displace the actuator piston 480 (e.g., downhole in the illustrated embodiment).

FIGS. 7A-10B are various different operational states and views of a pressure cycle actuation assembly 700 designed, manufactured, and operated according to the present disclosure. The pressure cycle actuation assembly 700 may include, without limitation, a cycling assembly 701 including a housing 705, a floating piston 710, a reciprocating piston 715 located within the housing 705 to form first and second fluid chamber 720, 725, a check valve 730 positioned between the first and second fluid chambers 720, 725, a flow restrictor 735 positioned between the first and second fluid chambers 720, 725, and a biasing device 740. The pressure cycle actuation assembly 700 may additionally include a rotation assembly 741 including a rotating collet 745 coupled to the reciprocating piston 715, the rotating collet 745 translating reciprocal axial motion of the reciprocating piston 715 into one-direction rotation and axial lengthening (or in another embodiment shortening) of the rotating collet 745 relative to the reciprocating piston 715, and a j-slot stationary profiled ring 755, the j-slot stationary profiled ring 755 coupled to the rotating collet 745 through a rotating sleeve 750. The rotation assembly 741 of the pressure cycle actuation assembly 700 may additionally include a rotating overshot 760 located within the housing 705, the rotating overshot 760 having a profile engageable with a profiled end of the rotating collet 745 as the rotating collet 745 lengthens relative to the reciprocating piston 715, and a shear feature 765 coupling the rotating overshot 760 to the actuator piston 770. The pressure cycle actuation assembly 700 may further include an initiation assembly 771, for example including a balanced valve 775. The pressure cycle actuation assembly 700 may yet further include a firing assembly 780, which may include a firing pin 785 and explosive initiator 790. The illustrated features of the pressure cycle actuation assembly 700 may, or may not, be identical to the similarly named features described above with respect to FIGS. 1-6. Each of FIGS. 7A-10B will be discussed using various different changes in pressure at points A, B, C, and D on the pressure cycle actuation assembly 700, and further be discussed as if the floating piston 710 is positioned uphole relative to the downhole firing assembly 780.

Figure 7A:
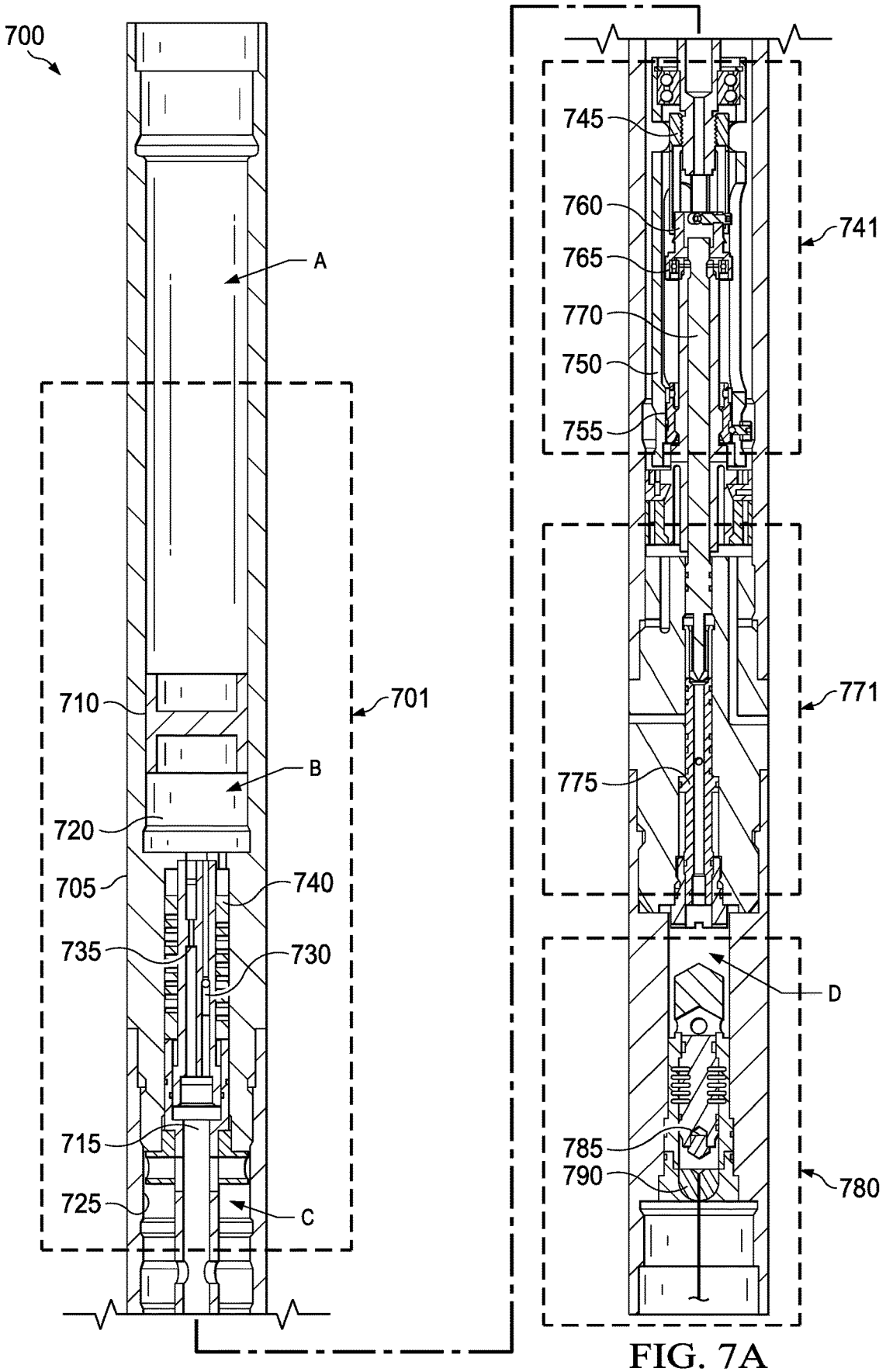
FIGS. 7A-10B are various different operational states and views of a pressure cycle actuation assembly designed, manufactured, and operated according to the present disclosure.
Figure 7B:
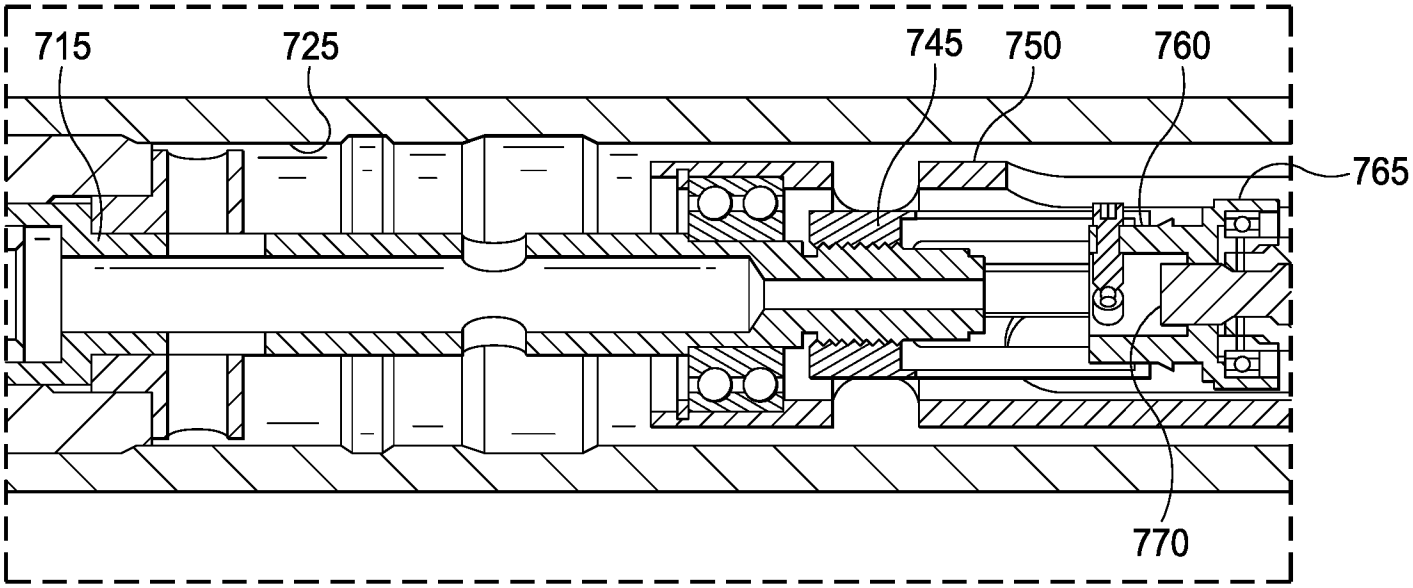

Turning initially to FIGS. 7A and 7B, illustrated is the pressure cycle actuation assembly 700 in its natural, balanced pressure state, such as if it were just deployed downhole within a wellbore. Accordingly, the pressure at points A, B, and C would be substantially similar to one another, and the pressure at point D would be significantly less than the pressure at points A, B, and C. In one example embodiment, the pressure at points A, B and C would be approximately 23000 psi, and the pressure at point D is atmospheric pressure.

In the illustrated embodiment of FIGS. 7A and 7B, the reciprocating piston 715 is biased toward the second fluid chamber 725 via the biasing device 740. As the reciprocating piston 715 is biased axially downhole, the rotating collet 745 is axially displaced partially downhole, extending over an edge of the rotating overshot 760. Additionally, the actuator piston 770 remains fixed to the rotating overshot 760 using the shear feature 765. Thus, in this configuration, the cycling assembly 701 remains balanced, the rotation assembly 741 remains inactive, the initiation assembly 771 remains inactive, and the firing assembly remains inactive, at atmospheric pressure.

Figure 8A:
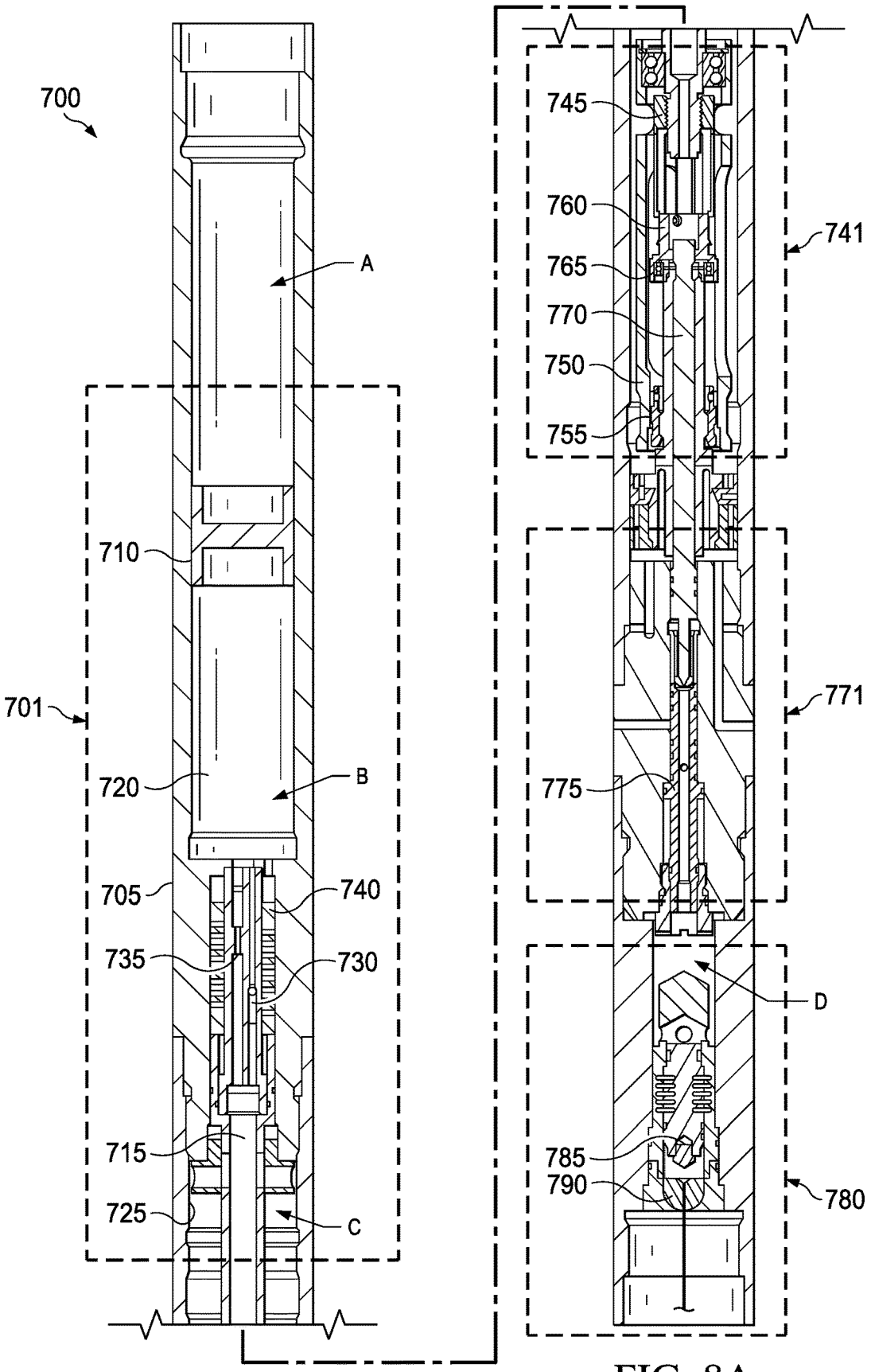
Figure 8B:
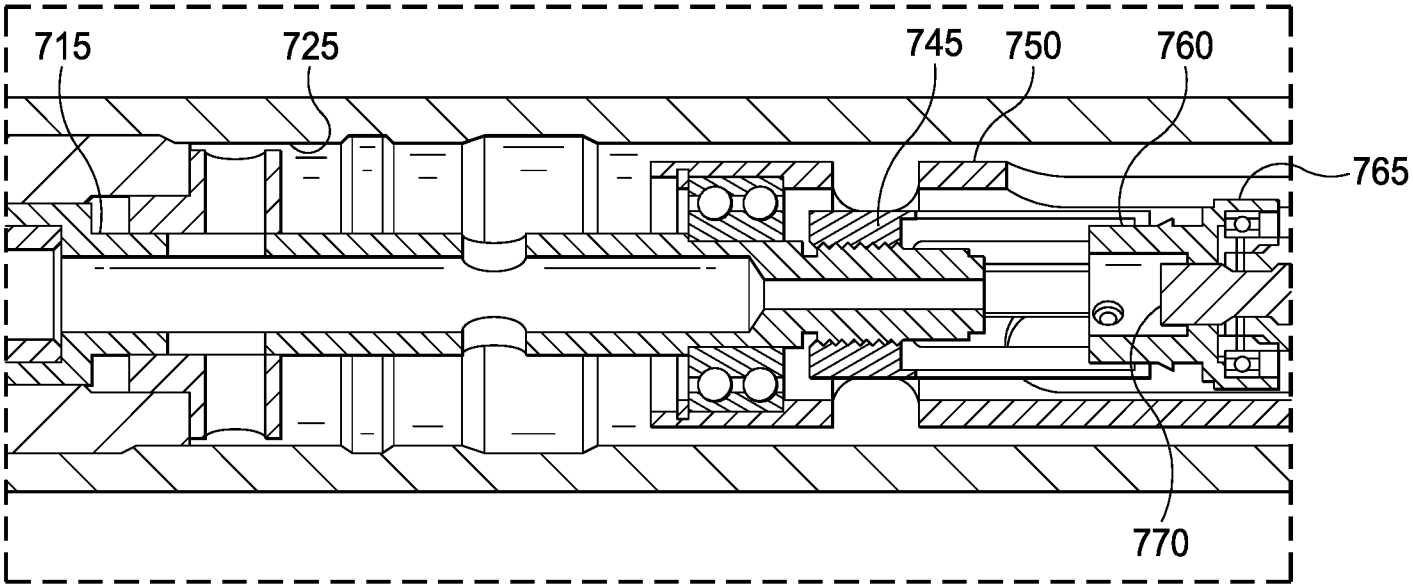
Figure 8C:
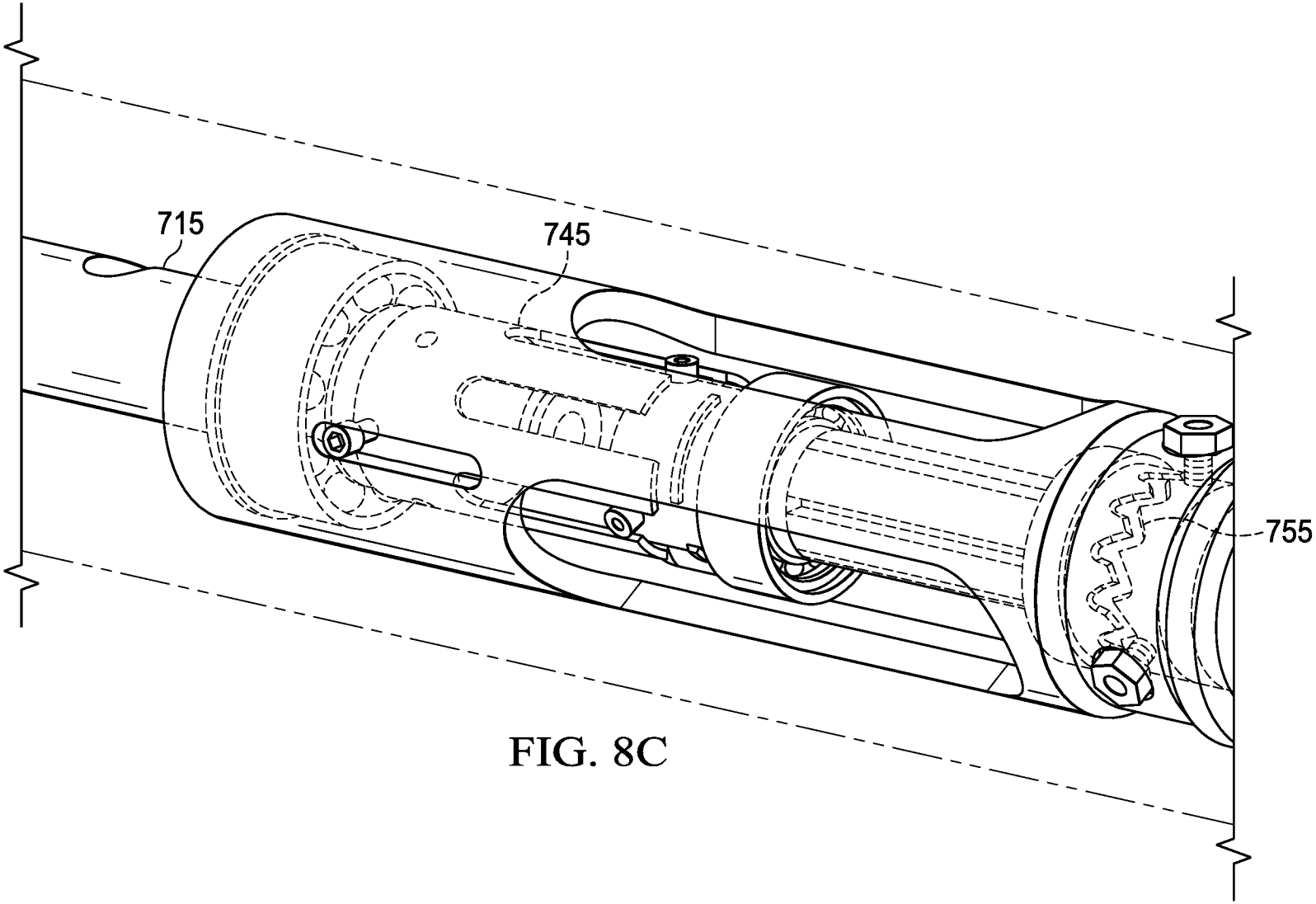

Turning to FIGS. 8A-8C, illustrated is the pressure cycle actuation assembly 700 shortly after lowering the pressure in the tubing. Accordingly, the pressure at points A and B would quickly equalize and thus be substantially similar to one another, the pressure at point C would be greater than the pressure at points A and B, and the pressure at point D would be significantly less than the pressure at points A, B, and C. In one example embodiment, the pressure at points A and B would be approximately 20000 psi, the pressure at point C would reduce slowly from 23000 psi, and the pressure at point D would remain at atmospheric pressure. For example, when pressure in the tubing is lowered the floating piston 710 would move uphole, and pressure in the first fluid chamber 720 would decrease faster than pressure in the second fluid chamber 725. This is due to the fact that the flow restrictor 735 permits only very restricted flow of the fluid from the second fluid chamber 725 to the first fluid chamber 720 and, therefore, pressure in the second fluid chamber 725 is relieved slower than pressure in the first fluid chamber 720.

In the illustrated embodiment of FIGS. 8A-8C, the reciprocating piston 715 is biased toward the first fluid chamber 720 as a result of the higher pressure in the second fluid chamber 725. When the reciprocating piston 715 axially moves from the downhole position illustrated in FIGS. 7A and 7B to the uphole position illustrated in FIGS. 8A-8C, the j-slot stationary profiled ring 755, rotating sleeve 750, and rotating collet 745 collectively translate the axial motion of the reciprocating piston 715 into one-direction rotation and axial lengthening of the rotating collet 745 relative to the reciprocating piston 715. Note how the rotating collet 745 illustrated in FIGS. 8A-8C has rotated relative to the reciprocating piston 715 as the reciprocating piston 715 has axially moved uphole. In certain other embodiments, however, the j-slot stationary profiled ring 755 is shaped such that rotation of the rotating collet 745 only occurs when the reciprocating piston 715 moves axially uphole, or alternatively only occurs when the reciprocating piston 715 moves axially downhole, and not as shown wherein the rotation of the rotating collet 745 occurs to some extent when the reciprocating piston 715 axially moves both uphole and downhole. Thus, in this configuration, the cycling assembly 701 is unbalanced, the rotation assembly 741 is active, the initiation assembly 771 remains inactive, and the firing assembly remains inactive, at atmospheric pressure.

After a period of time, the flow restrictor 735 permits the pressure within the second fluid chamber 725 to equalize with the pressure in the first fluid chamber 720, and thus the biasing device 740 returns the reciprocating piston toward the second fluid chamber 725. This axial motion, again, may be translated into rotational motion of the rotating collet 745, and thus lengthening of the rotating collet 745 relative to the reciprocating piston 715.

The process described in FIGS. 7A-8C may be repeated any number of times, and thus the reciprocating piston 715 can be conveniently reciprocated by simply increasing and decreasing pressure in the flow passage of the tubular string. This reciprocating displacement of the reciprocating piston 715 may be used to incrementally lengthen the rotating collet 745 downhole relative to the reciprocating piston 715 so that, after a certain number of the pressure increases and decreases, the firing pin 785 is released to impact the explosive initiator 790.

Figure 9A:
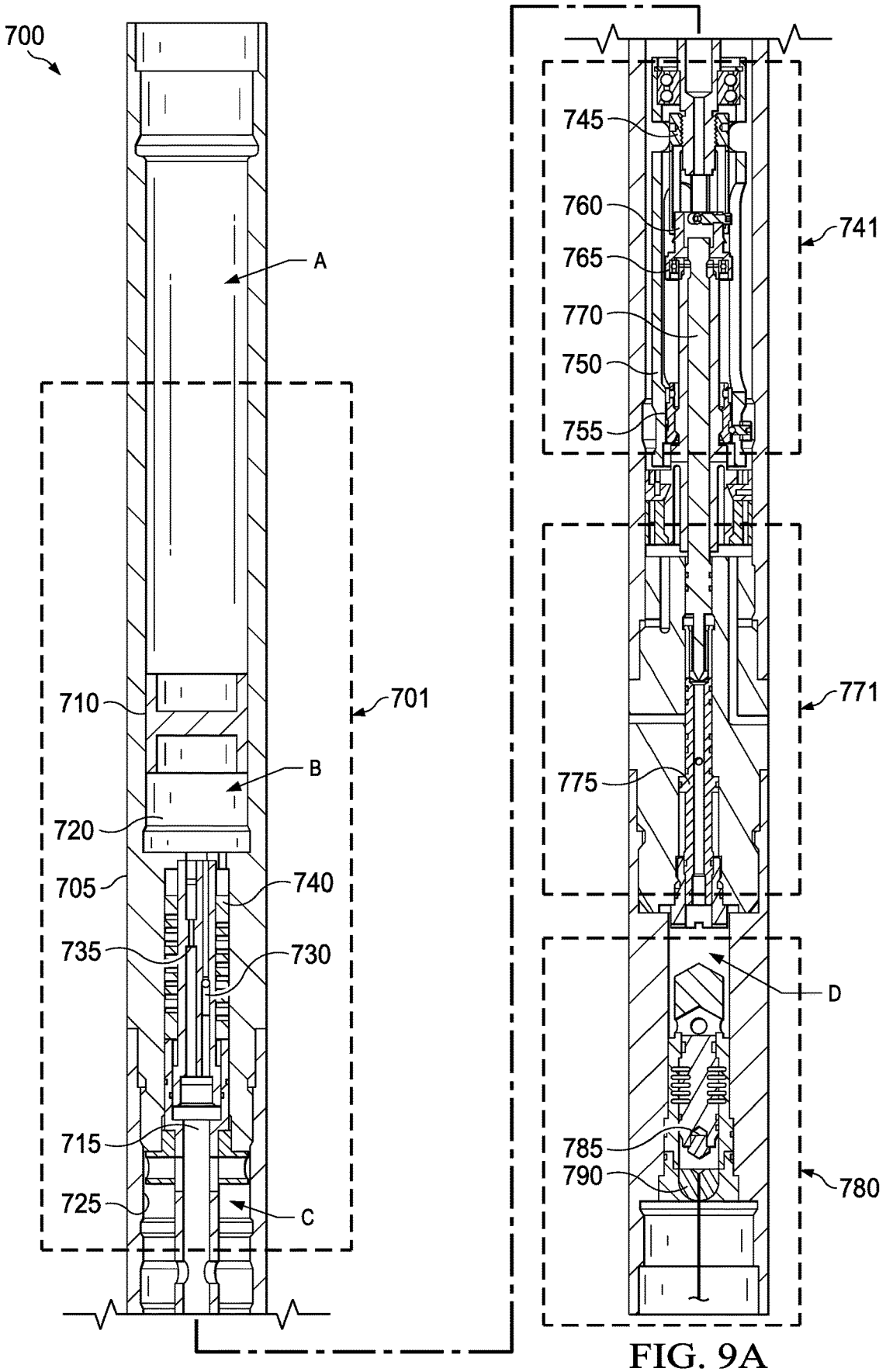
Figure 9B:
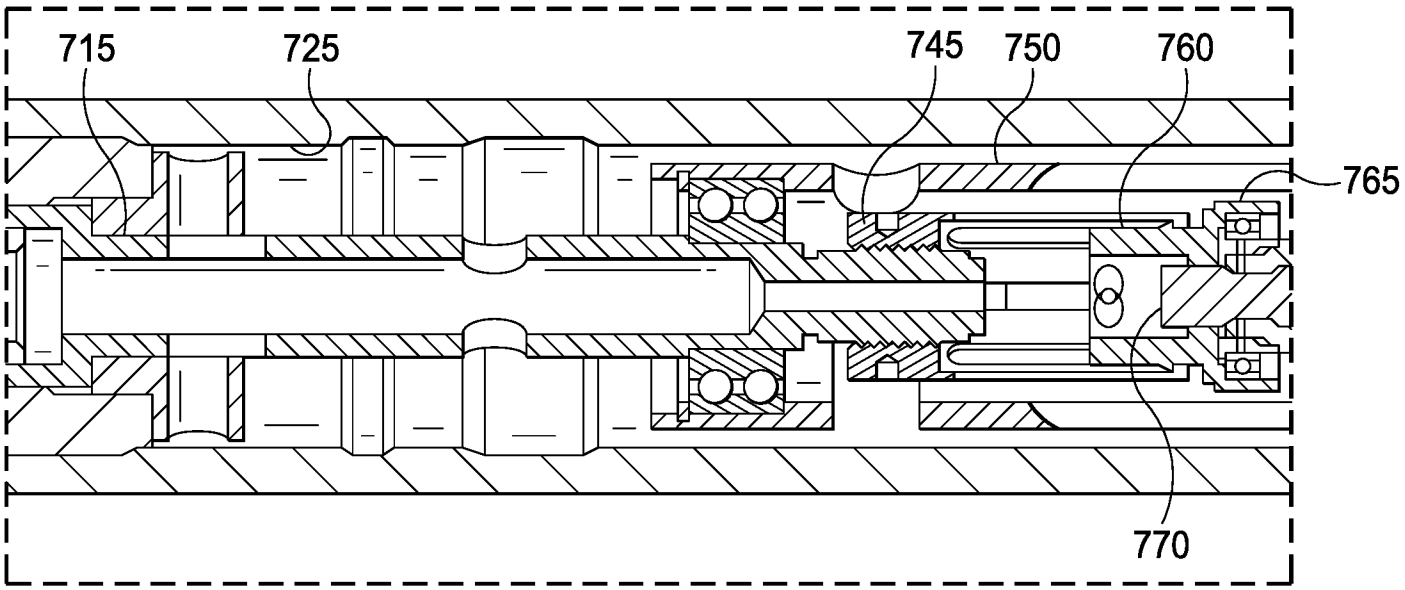
Figure 9C:
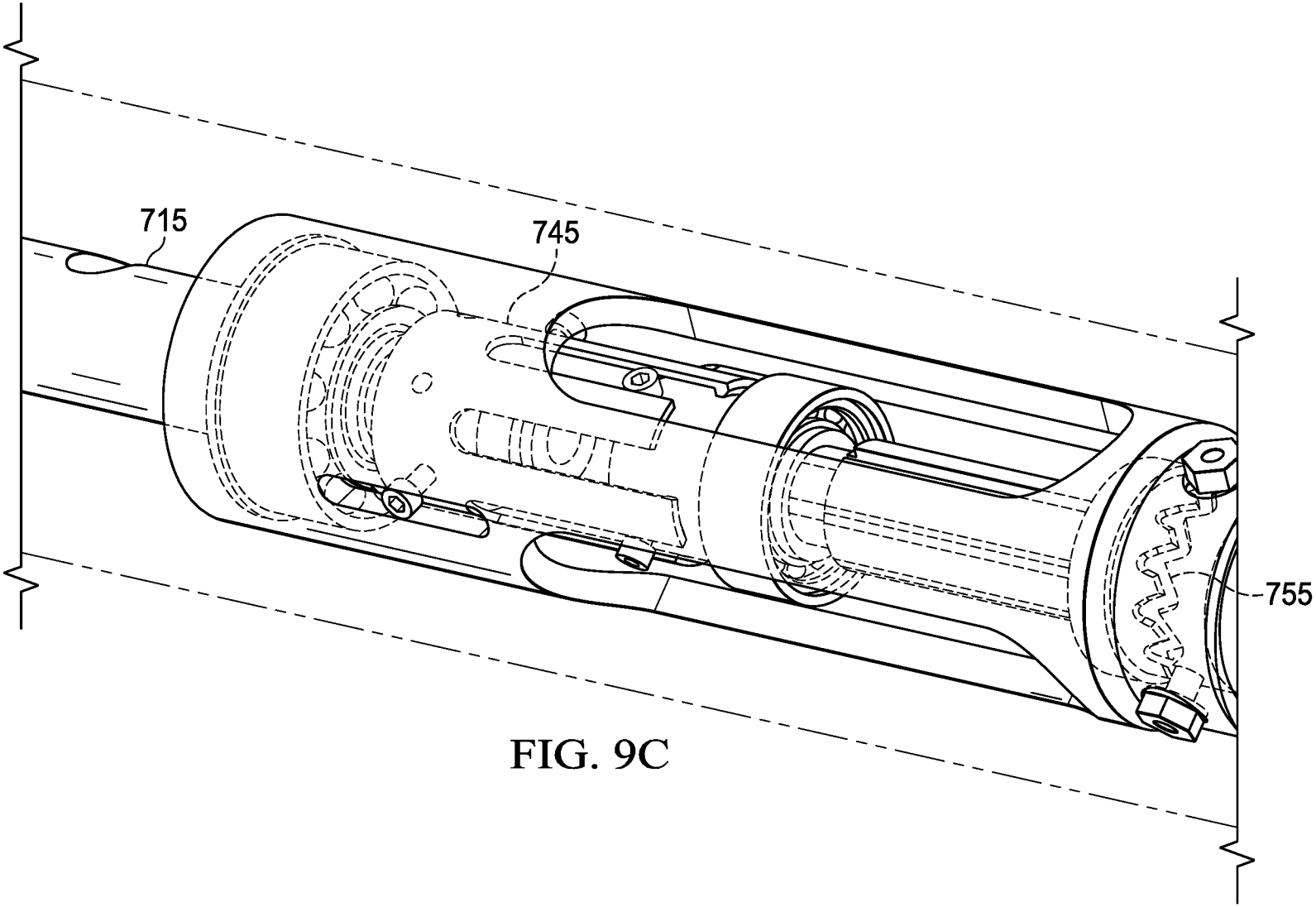

Moreover, the pressure cycle actuation assembly 700 may be designed so that a specific number of pressure cycles must be conducted prior to the profiled end of the rotating collet 745 engaging with the profile of the rotating overshot 760, such as shown in FIG. 9A-9C. Additionally, the pressure cycle actuation assembly 700 may be designed, for example by changing the spring constant of the biasing device 740 or size of the flow restrictor 735, such that specific pressure increases and drops, and furthermore specific rates of increases and drops, are necessary to axially move the reciprocating piston 715 and thus allow the rotating collet 745 to translate the reciprocal axial motion of the reciprocating piston 715 into one-direction rotation and axial lengthening of the rotating collet 745 relative to the reciprocating piston 715. In accordance with one embodiment, a pressure cycle does not register if the reciprocating piston 715 does not axially move. Accordingly, lower pressure increases and drops and/or lower rates of increases and drops may be used to test the pressure cycle actuation assembly 700, or any other downhole tool in the wellbore, without registering as a pressure cycle. In accordance with one embodiment, the rate of increase or drop necessary to register a pressure cycle is at least about 1000 psi/minute. In accordance with another embodiment, the rate of increase or drop necessary to register a pressure cycle is at least about 2000 psi/minute, and in yet another embodiment at least about 3000 psi/minute. Such is helpful if the operator needs to conduct many different pressure tests in the wellbore prior to wanting to actuate the pressure cycle actuation assembly. Moreover, this is particularly helpful when the downhole tool is a perforating gun, and the operator does not want the perforating gun to inadvertently fire when conducting extraneous pressure tests within the wellbore.

Figure 10A:
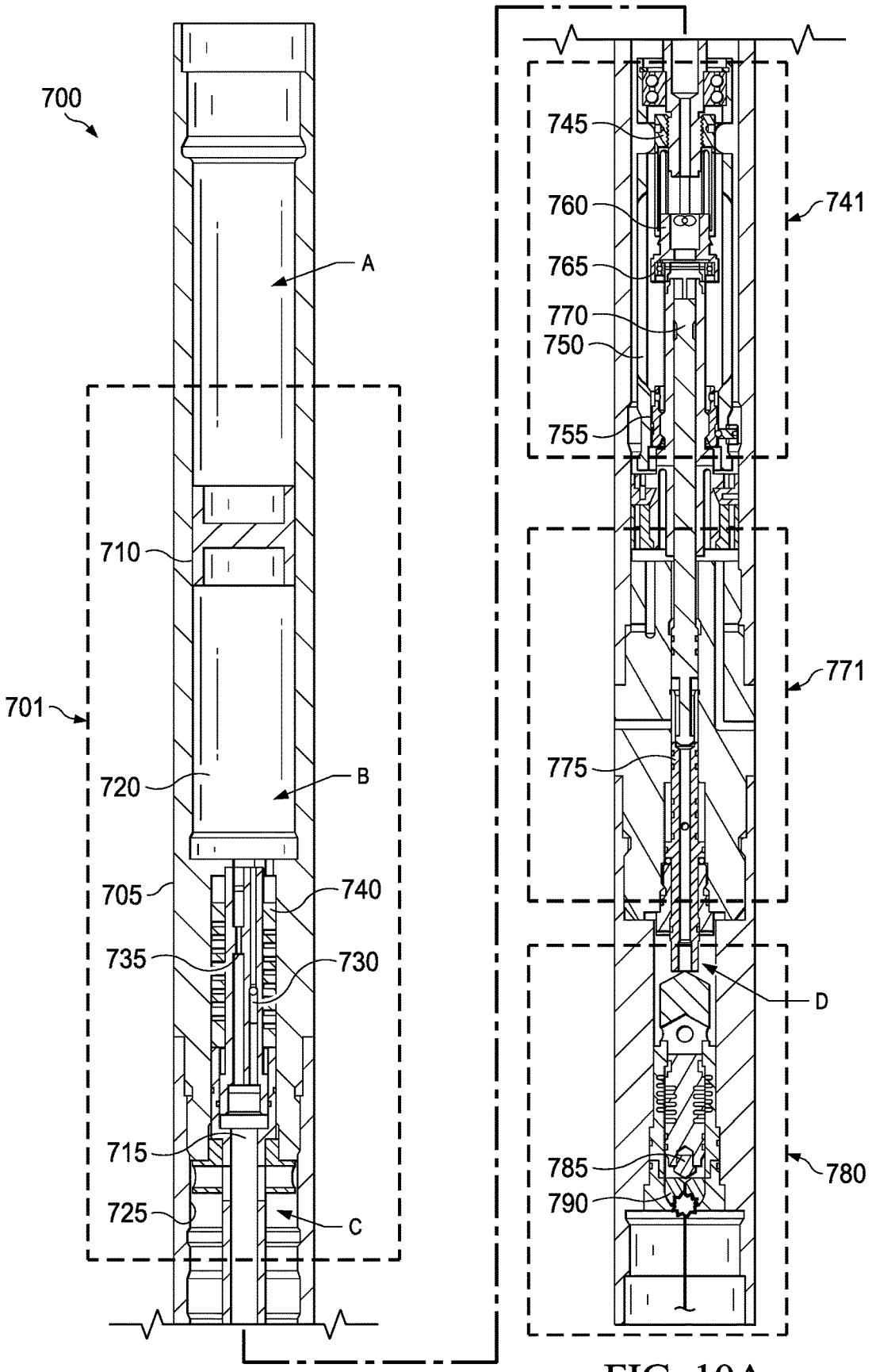
Figure 10B:
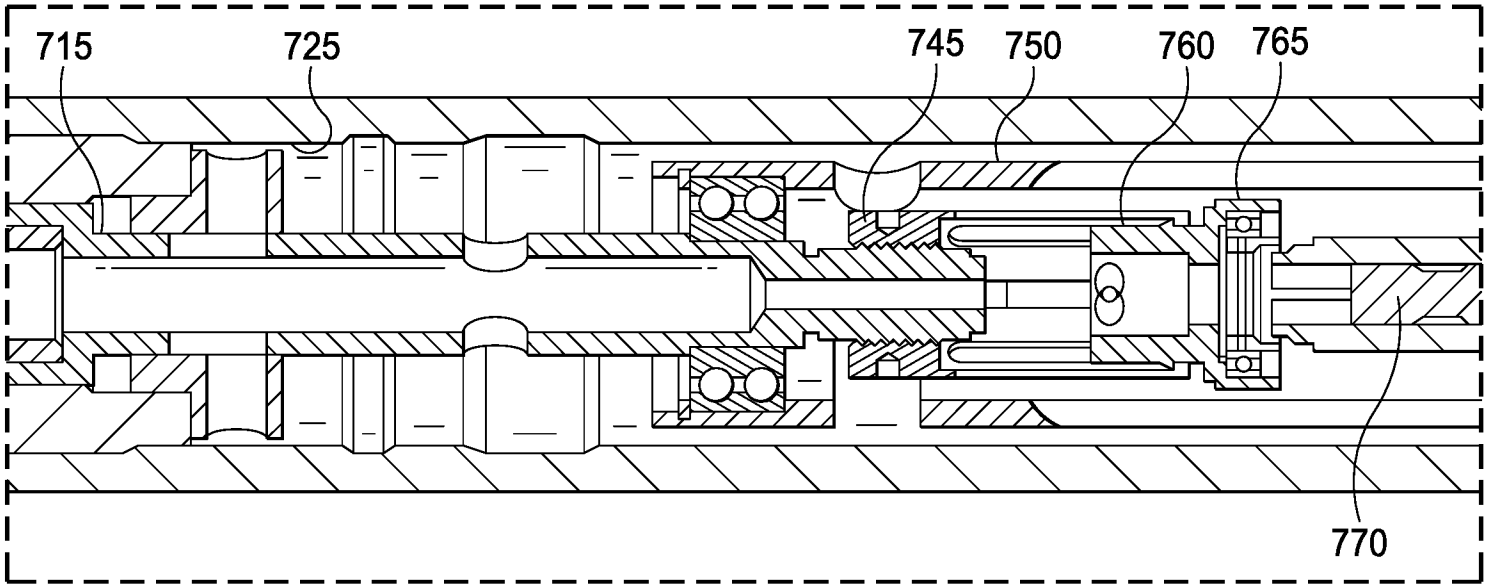

Turning finally to FIGS. 10A and 10B, illustrated is the pressure cycle actuation assembly 700 after conducting one last pressure cycle, thereby inducing axial movement of the reciprocating piston 715 and, as a result of the profiled end of the rotating collet 745 being engaged with the profile in the rotating overshot 760, shearing the shear device 765. Again, with the shear device 765 having been sheared, a pressure differential across the actuator piston 770 displaces the actuator piston 770 forcibly downhole, and in certain embodiments causes the firing pin 785 to forcibly contact the explosive initiator 790.

A pressure cycle actuation assembly, designed and manufactured according to the present disclosure, has many advantages over existing structures. For example, the translation of the reciprocal axial motion into rotational motion helps prevent excessive counting due to axial jarring, which is particularly advantageous when the downhole tool is a perforating gun. Additionally, such a device can be run on both top and bottom configurations. Moreover, the pressure cycling and hydrostatic pressures, in one embodiment, are completely isolated from the downhole tool. For example, no pressures act on any part of the firing assembly or firing pin until the cycle counting is complete.

Aspects disclosed herein include:

A. A pressure cycle actuation assembly, comprising: a housing; a reciprocating piston located within the housing and defining first and second fluid chambers; a check valve positioned between the first and second fluid chambers, the check valve permitting fluid flow from the first fluid chamber to the second fluid chamber but preventing fluid flow from the second fluid chamber to the first fluid chamber; a flow restrictor positioned between the first and second fluid chambers, the flow restrictor restricting fluid flow between the first fluid chamber and the second fluid chamber; and a rotating collet coupled to the reciprocating piston, the rotating collet translating reciprocal axial motion of the reciprocating piston into one-direction rotation and axial lengthening or shortening of the rotating collet relative to the reciprocating piston.

B. A method for actuating a downhole tool, comprising: providing a pressure cycle actuation assembly within a tubular string located within a wellbore, the pressure cycle actuation assembly including 1) a housing, 2) a reciprocating piston located within the housing and defining first and second fluid chambers, 3) a check valve positioned between the first and second fluid chambers, the check valve permitting fluid flow from the first fluid chamber to the second fluid chamber but preventing fluid flow from the second fluid chamber to the first fluid chamber, 4) a flow restrictor positioned between the first and second fluid chambers, the flow restrictor restricting fluid flow between the first fluid chamber and the second fluid chamber; and 5) a rotating collet coupled to the reciprocating piston; creating a balanced pressure state between the first fluid chamber and the second fluid chamber using the flow restrictor; and lowering a pressure of the first fluid chamber to induce axial movement of the reciprocating piston, the rotating collet translating the axial movement of the reciprocating piston into one-direction rotation and axial lengthening or shortening of the rotating collet relative to the reciprocating piston.

C. A well system, comprising: a tubular string located within a wellbore; a pressure cycle actuation assembly located within the tubular string, the pressure cycle actuation assembly including 1) a housing, 2) a reciprocating piston located within the housing and defining first and second fluid chambers, 3) a check valve positioned between the first and second fluid chambers, the check valve permitting fluid flow from the first fluid chamber to the second fluid chamber but preventing fluid flow from the second fluid chamber to the first fluid chamber, 4) a flow restrictor positioned between the first and second fluid chambers, the flow restrictor restricting fluid flow between the first fluid chamber and the second fluid chamber; and 5) a rotating collet threadingly coupled to the reciprocating piston, the rotating collet translating reciprocal axial motion of the reciprocating piston into one-direction rotation and axial lengthening or shortening of the rotating collet relative to the reciprocating piston; and a downhole tool coupled to the pressure cycle actuation assembly, the downhole tool initiatable in response to the one-direction rotation and axial lengthening or shortening of the rotating collet relative to the reciprocating piston.

Aspects A, B, and C may have one or more of the following additional elements in combination: Element 1: further including a stationary profiled ring, the stationary profiled ring coupled to the rotating collet through a rotating sleeve, the stationary profiled ring and the rotating collet translating the reciprocal axial motion of the reciprocating piston into one-direction rotation and axial lengthening or shortening of the rotating collet relative to the reciprocating piston. Element 2: wherein the stationary profiled ring is a j-slot stationary profiled ring, and further wherein a follower coupled to the rotating sleeve follows a path of the j-slot stationary profiled ring thereby translating the reciprocal axial motion of the reciprocating piston into one-direction rotation and axial lengthening or shortening of the rotating collet relative to the reciprocating piston. Element 3: further including a rotating overshot located within the housing, the rotating overshot having a profile engageable with a profiled end of the rotating collet as the rotating collet lengthens or shortens relative to the reciprocating piston. Element 4: wherein the rotating overshot is coupleable to an actuator piston using a shear feature, and further wherein the shear feature is shearable when the profile of the rotating overshot engages with the profiled end of the rotating collet and the reciprocating piston is withdrawn. Element 5: whereby a pressure differential across the actuator piston displaces the actuator piston when the shear feature is sheared. Element 6: wherein the rotating collet is threadingly coupled to the reciprocating piston. Element 7: further including a biasing device for biasing the reciprocating piston toward the second fluid chamber when the first fluid chamber and the second fluid chamber are in a balanced pressure state. Element 8: further including repeatedly creating a balanced pressure state then lowering the pressure of the first fluid chamber until a profiled end of the rotating collet axial lengthens or shortens to engage a profile of a rotating overshot located within the housing. Element 9: wherein the repeatedly creating the balanced pressure state then lowering the pressure of the first fluid chamber shears a shear device coupled between the rotating overshot and an actuator piston allowing a pressure differential across the actuator piston to displace the actuator piston to initiate a downhole tool. Element 10: wherein the downhole tool is a perforating gun. Element 11: wherein the pressure cycle actuation assembly further includes a stationary profiled ring, the stationary profiled ring coupled to the rotating collet through a rotating sleeve, the stationary profiled ring and the rotating collet translating the axial motion of the reciprocating piston into one-direction rotation and axial lengthening or shortening of the rotating collet relative to the reciprocating piston. Element 12: wherein the stationary profiled ring is a j-slot stationary profiled ring, and further wherein a follower coupled to the rotating sleeve follows a path of the j-slot stationary profiled ring thereby translating the axial motion of the reciprocating piston into one-direction rotation and axial lengthening or shortening of the rotating collet relative to the reciprocating piston. Element 13: wherein lowering the pressure of the first fluid chamber to induce axial movement of the reciprocating piston includes lowering the pressure at a rate of at least about 1000 psi/minute. Element 14: wherein lowering the pressure of the first fluid chamber to induce axial movement of the reciprocating piston includes lowering the pressure at a rate of at least about 2000 psi/minute. Element 15: wherein the downhole tool is a perforating gun. Element 16: further including a j-slot stationary profiled ring located in the housing, the j-slot stationary profiled ring coupled to the rotating collet through a follower coupled to a rotating sleeve, and further wherein the follower follows a path of the j-slot stationary profiled ring thereby translating the reciprocal axial motion of the reciprocating piston into one-direction rotation and axial lengthening or shortening of the rotating collet relative to the reciprocating piston. Element 17: further including a rotating overshot located within the housing, the rotating overshot having a profile engageable with a profiled end of the rotating collet as the rotating collet lengthens or shortens relative to the reciprocating piston, and further wherein the rotating overshot is coupleable to an actuator piston using a shear feature, the shear feature being shearable when the profile of the rotating overshot engages with the profiled end of the rotating collet and the reciprocating piston is withdrawn, thereby allowing a pressure differential across the actuator piston to displace the actuator piston when the shear feature is sheared.

Those skilled in the art to which this application relates will appreciate that other and further additions, deletions, substitutions and modifications may be made to the described embodiments.

What is claimed is:

1. A pressure cycle actuation assembly, comprising:

a housing;

a reciprocating piston located within the housing and defining first and second fluid chambers;

a check valve positioned between the first and second fluid chambers, the check valve permitting fluid flow from the first fluid chamber to the second fluid chamber but preventing fluid flow from the second fluid chamber to the first fluid chamber;

a flow restrictor positioned between the first and second fluid chambers, the flow restrictor restricting fluid flow between the first fluid chamber and the second fluid chamber; and a rotating collet coupled to the reciprocating piston, the rotating collet translating reciprocal axial motion of the reciprocating piston into one-direction rotation and axial lengthening or shortening of the rotating collet relative to the reciprocating piston.

2. The pressure cycle actuation assembly as recited in claim 1, further including a stationary profiled ring, the stationary profiled ring coupled to the rotating collet through a rotating sleeve, the stationary profiled ring and the rotating collet translating the reciprocal axial motion of the reciprocating piston into one-direction rotation and axial lengthening or shortening of the rotating collet relative to the reciprocating piston.

3. The pressure cycle actuation assembly as recited in claim 2, wherein the stationary profiled ring is a j-slot stationary profiled ring, and further wherein a follower coupled to the rotating sleeve follows a path of the j-slot stationary profiled ring thereby translating the reciprocal axial motion of the reciprocating piston into one-direction rotation and axial lengthening or shortening of the rotating collet relative to the reciprocating piston.

4. The pressure cycle actuation assembly as recited in claim 1, further including a rotating overshot located within the housing, the rotating overshot having a profile engageable with a profiled end of the rotating collet as the rotating collet lengthens or shortens relative to the reciprocating piston.

5. The pressure cycle actuation assembly as recited in claim 4, wherein the rotating overshot is coupleable to an actuator piston using a shear feature, and further wherein the shear feature is shearable when the profile of the rotating overshot engages with the profiled end of the rotating collet and the reciprocating piston is withdrawn.

6. The pressure cycle actuation assembly as recited in claim 5, whereby a pressure differential across the actuator piston displaces the actuator piston when the shear feature is sheared.

7. The pressure cycle actuation assembly as recited in claim 1, wherein the rotating collet is threadingly coupled to the reciprocating piston.

8. The pressure cycle actuation assembly as recited in claim 1, further including a biasing device for biasing the reciprocating piston toward the second fluid chamber when the first fluid chamber and the second fluid chamber are in a balanced pressure state.

9. A method for actuating a downhole tool, comprising:

providing a pressure cycle actuation assembly within a tubular string located within a wellbore, the pressure cycle actuation assembly including;

a housing;

a reciprocating piston located within the housing and defining first and second fluid chambers;

a check valve positioned between the first and second fluid chambers, the check valve permitting fluid flow from the first fluid chamber to the second fluid chamber but preventing fluid flow from the second fluid chamber to the first fluid chamber;

a flow restrictor positioned between the first and second fluid chambers, the flow restrictor restricting fluid flow between the first fluid chamber and the second fluid chamber; and a rotating collet coupled to the reciprocating piston;

creating a balanced pressure state between the first fluid chamber and the second fluid chamber using the flow restrictor; and lowering a pressure of the first fluid chamber to induce axial movement of the reciprocating piston, the rotating collet translating the axial movement of the reciprocating piston into one-direction rotation and axial lengthening or shortening of the rotating collet relative to the reciprocating piston.

10. The method as recited in claim 9, further including repeatedly creating a balanced pressure state then lowering the pressure of the first fluid chamber until a profiled end of the rotating collet axial lengthens or shortens to engage a profile of a rotating overshot located within the housing.

11. The method as recited in claim 10, wherein the repeatedly creating the balanced pressure state then lowering the pressure of the first fluid chamber shears a shear device coupled between the rotating overshot and an actuator piston allowing a pressure differential across the actuator piston to displace the actuator piston to initiate a downhole tool.

12. The method as recited in claim 11, wherein the downhole tool is a perforating gun.

13. The method as recited in claim 9, wherein the pressure cycle actuation assembly further includes a stationary profiled ring, the stationary profiled ring coupled to the rotating collet through a rotating sleeve, the stationary profiled ring and the rotating collet translating the axial motion of the reciprocating piston into one-direction rotation and axial lengthening or shortening of the rotating collet relative to the reciprocating piston.

14. The method as recited in claim 13, wherein the stationary profiled ring is a j-slot stationary profiled ring, and further wherein a follower coupled to the rotating sleeve follows a path of the j-slot stationary profiled ring thereby translating the axial motion of the reciprocating piston into one-direction rotation and axial lengthening or shortening of the rotating collet relative to the reciprocating piston.

15. The method as recited in claim 9, wherein lowering the pressure of the first fluid chamber to induce axial movement of the reciprocating piston includes lowering the pressure at a rate of at least about 1000 psi/minute.

16. The method as recited in claim 9, wherein lowering the pressure of the first fluid chamber to induce axial movement of the reciprocating piston includes lowering the pressure at a rate of at least about 2000 psi/minute.

17. A well system, comprising:

a tubular string located within a wellbore;

a pressure cycle actuation assembly located within the tubular string, the pressure cycle actuation assembly including;

a housing;

a reciprocating piston located within the housing and defining first and second fluid chambers;

a check valve positioned between the first and second fluid chambers, the check valve permitting fluid flow from the first fluid chamber to the second fluid chamber but preventing fluid flow from the second fluid chamber to the first fluid chamber;

a flow restrictor positioned between the first and second fluid chambers, the flow restrictor restricting fluid flow between the first fluid chamber and the second fluid chamber; and a rotating collet threadingly coupled to the reciprocating piston, the rotating collet translating reciprocal axial motion of the reciprocating piston into one-direction rotation and axial lengthening or shortening of the rotating collet relative to the reciprocating piston; and a downhole tool coupled to the pressure cycle actuation assembly, the downhole tool initiatable in response to the one-direction rotation and axial lengthening or shortening of the rotating collet relative to the reciprocating piston.

18. The well system as recited in claim 17, wherein the downhole tool is a perforating gun.

19. The well system as recited in claim 17, further including a j-slot stationary profiled ring located in the housing, the j-slot stationary profiled ring coupled to the rotating collet through a follower coupled to a rotating sleeve, and further wherein the follower follows a path of the j-slot stationary profiled ring thereby translating the reciprocal axial motion of the reciprocating piston into one-direction rotation and axial lengthening or shortening of the rotating collet relative to the reciprocating piston.

20. The well system as recited in claim 17, further including a rotating overshot located within the housing, the rotating overshot having a profile engageable with a profiled end of the rotating collet as the rotating collet lengthens or shortens relative to the reciprocating piston, and further wherein the rotating overshot is coupleable to an actuator piston using a shear feature, the shear feature being shearable when the profile of the rotating overshot engages with the profiled end of the rotating collet and the reciprocating piston is withdrawn, thereby allowing a pressure differential across the actuator piston to displace the actuator piston when the shear feature is sheared.

* * * * *